US009312060B2

(12) United States Patent
Godoy et al.

(10) Patent No.: US 9,312,060 B2
(45) Date of Patent: Apr. 12, 2016

(54) TRANSFORMER CIRCUITS HAVING TRANSFORMERS WITH FIGURE EIGHT AND DOUBLE FIGURE EIGHT NESTED STRUCTURES

(71) Applicant: Marvell World Trade Ltd., St. Michael (BB)

(72) Inventors: Philip Godoy, Sunnyvale, CA (US); David M. Signoff, Santa Clara, CA (US); Ming He, Fremont, CA (US); Li Lin, Saratoga, CA (US)

(73) Assignee: Marvell World Trade Ltd., St. Michael (BB)

( * ) Notice: Subject to any disclaimer, the term of this patent is extended or adjusted under 35 U.S.C. 154(b) by 172 days.

(21) Appl. No.: 14/028,835

(22) Filed: Sep. 17, 2013

(65) Prior Publication Data

US 2014/0077919 A1 Mar. 20, 2014

Related U.S. Application Data

(60) Provisional application No. 61/703,576, filed on Sep. 20, 2012.

(51) Int. Cl.

| | |
|---|---|
| ***H01F 27/28*** | (2006.01) |
| ***H01F 27/00*** | (2006.01) |
| ***H01F 30/08*** | (2006.01) |

(52) U.S. Cl.

CPC ..... *H01F 27/006* (2013.01); *H01F 27/2804* (2013.01); *H01F 30/08* (2013.01); *H01F 2027/2809* (2013.01)

(58) Field of Classification Search

CPC ..... H01F 27/006
USPC ..... 336/225, 226
See application file for complete search history.

(56) References Cited

U.S. PATENT DOCUMENTS

| | | | | |
|---|---|---|---|---|
| 6,970,064 | B2 * | 11/2005 | Zhang et al. | 336/200 |
| 8,378,750 | B2 | 2/2013 | Sutardja | |
| 8,400,232 | B2 | 3/2013 | Leong | |
| 2010/0060375 | A1 | 3/2010 | Chen | |
| 2010/0060402 | A1 | 3/2010 | Chen | |
| 2011/0148733 | A1 * | 6/2011 | Fahs et al. | 343/859 |

FOREIGN PATENT DOCUMENTS

WO WO-2012085670 A1 6/2012

OTHER PUBLICATIONS

IEEE 2008, CICC; "Twisted Inductors for Low Coupling Mixed-Signal and RF Applications"; Nathan M. Neihart, David Allstot, Matt Miller, Pat Rakers; Univ.of Washington, Seatle, WA 98195; Freescale Semiconductor Inc., Lake Zurich, IL 60047.

(Continued)

*Primary Examiner* — Elvin G Enad
*Assistant Examiner* — Ronald Hinson

(57) ABSTRACT

A transformer includes a first loops and second loops. The first loops include a first set of input terminals. The first loops include at least three loops that are conductively coupled to each other in series by first crossovers. The second loops include a first set of output terminals. The second loops include at least three loops that are conductively coupled to each other in series by second crossovers. Each of the second conductive loops is inductively coupled to and nested within a respective one of the first conductive loops.

22 Claims, 15 Drawing Sheets

(56) References Cited

OTHER PUBLICATIONS

Proceeding of Asia-Pacific Microwave Conference 2007; Twisted Inductor VCO for Supressing On-chip Interrerences; Nobuyuki Itoh, Hideaki, Masuoka, Shin-ichi Fukase, Ken-ichi Hirashiki, Minoru Nagata; Semiconductor Company, Toshiba Corporation, Yokohama, JP.

IEEE Journal of Solid-State Circuits, vol. 44. No. 6, Jun. 2009; Reduction of Inductive Crosstalk Using Quadrupole Inductors; Andrew Poon, Andrew Chang, Hirad Samavati, S. Simon Wong.

International Search Report and Written Opinion for PCT Application No. PCT/US2013/060289 mailed Jan. 21, 2014; 10 pages.

IEEE Std. 802.11-2012; IEEE Standard for Information technology—Telecommunications and information exchange between systems Local and metropolitan area networks—Specific requirements; Part 11: Wireless LAN Medium Access Control (MAC) and Physical Layer (PHY) Specifications; IEEE Computer Society; Sponsored by the LAN/MAN Standards Committee; Mar. 29, 2012; 2793 pages.

802.16-2009 IEEE Standard for Local and Metropolitan area networks; Part 16: Air Interface for Broadband Wireless Access Systems; IEEE Computer Society and the IEEE Microwave Theory and Techniques Society; Sponsored by the LAN/MAN Standard Committee; May 29, 2009; 2082 pages.

IEEE Std 802.20-2008; IEEE Standard for Local and metropolitan area networks; Part 20: Air Interface for Mobile Broadband Wireless Access Systems Supporting Vehicular Mobility-Physical and Media Access Control Layer Specification; IEEE Computer Society; Sponsored by the LAN/MAN Standards Committee; Aug. 29, 2008; 1032 pages.

"Specification of the Bluetooth System" Master Table of Contents & Compliance Requirements—Covered Core Package version: 4.0; Jun. 30, 2010; 2302 pages.

IEEE P802.11ac / D2.0; Draft Standard for Information Technology—Telecommunications and information exchange between systems—Local and metropolitan area networks—Specific requirements; Part 11: Wireless LAN Medium Access Control (MAC) and Physical Layer (PHY) specifications; Amendment 4: Enhancements for Very High Throughput for Operation in Bands below 6 GHz; Prepared by the 802.11 Working Group of the 802 Committee; Jan. 2012; 359 pages.

IEEE P802.11ad / D5.0 (Draft Amendment based on IEEE P802.11REVmb D10.0) (Amendment to IEEE 802.11REVmb D10.0 as amended by IEEE 802.11ae D5.0 and IEEE 802.11aa D6.0); Draft Standard for Information Technology—Telecommunications and Information Exchange Between Systems—Local and Metropolitan Area Networks—Specific Requirements; Part 11: Wireless LAN Medium Access Control (MAC) and Physical Layer (PHY) Specifications—Amendment 3: Enhancements for Very High Throughput in the 60 GHz Band; Sponsor IEEE 802.11 Committee of the IEEE Computer Society; Sep. 2011; 601 pages.

IEEE P802.11ah / D1.0 (Amendment to IEEE Std 802.11REVmc / D1.1, IEEE Std 802.11ac / D5.0 and IEEE Std 802.11af / D3.0) Draft Standard for Information technology—Telecommunications and information exchange between systems Local and metropolitan area networks—Specific requirements; Part 11: Wireless LAN Medium Access Control (MAC) and Physical Layer (PHY) Specifications; Amendment 6: Sub 1 GHz License Exempt Operation; Prepared by the 802.11 Working Group of the LAN/MAN Standards Committee of the IEEE Computer Society; Oct. 2013; 394 pages.

* cited by examiner

TRANSFORMER CIRCUITS HAVING TRANSFORMERS WITH FIGURE EIGHT AND DOUBLE FIGURE EIGHT NESTED STRUCTURES

CROSS-REFERENCE TO RELATED APPLICATIONS

This application claims the benefit of U.S. Provisional Application No. 61/703,576, filed on Sep. 20, 2012. The entire disclosure of the application referenced above is incorporated herein by reference.

FIELD

The present disclosure relates to integrated circuits, and more particularly to inductor and transformer structures incorporated in integrated circuits.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

An integrated circuit (or chip) includes many circuit components located in a confined space. The circuit components can include inductors and transformers. Separate inductors and transformers can magnetically couple to each other across spaces between the inductors and transformers. A first inductor or transformer that generates a magnetic field is referred to as an "aggressor". A second inductor or transformer that receives the magnetic field is referred to as a "victim".

Typically, to minimize the magnetic coupling between aggressors and victims on an integrated circuit, distances between the aggressors and victims are maximized. However, as the sizes of chips are reduced, the available area over which to locate the aggressors and victims and the distances between the aggressors and victims decrease. This limits the ability to minimize the magnetic coupling.

In addition, an integrated circuit may include one or more transceivers. Each of the transceivers may include a power amplifier circuit having power amplifiers. Due to the inclusion and close proximity of inductors and/or transformers in the power amplifier circuit, crosstalk (i.e. interference) and feedback between amplifiers of the power amplifier circuit can be experienced. Local oscillator pulling can also be experienced. Local oscillator pulling may refer to, for example, when a portion of a transmit signal of a transceiver couples back to a voltage controlled oscillator. The transmit signal is modulated, which causes the voltage controlled oscillator to also be modulated.

SUMMARY

A transformer is provided and includes a first loops and second loops. The first loops include a first set of input terminals. The first loops include at least three loops that are conductively coupled to each other in series by first crossovers. The second loops include a first set of output terminals. The second loops include at least three loops that are conductively coupled to each other in series by second crossovers.

Each of the second conductive loops is inductively coupled to and nested within a respective one of the first conductive loops.

In other features, a transformer is provided and includes: a set of input terminals; a first set of output terminals; and windings. The windings include a first winding and a second winding. The first winding has a figure eight structure and is conductively coupled to the set of input terminals. The figure eight structure includes a first loop and a second loop. The first loop and the second loop are conductively coupled to each other via a crossover. The second winding does not have a figure eight structure. The second winding is conductively coupled to the first set of output terminals. The second winding is nested in and inductively coupled to one of the first loop of the first winding and the second loop of the first winding.

In other features, a transformer circuit is provided and includes a first transformer and a second transformer. The first transformer includes a first winding having a first loop, and a second winding having a second loop, where the second loop is nested within the first loop. The second transformer is nested within the first transformer. The second transformer includes a third winding having a figure eight structure, and a fourth winding having a figure eight structure. Loops of the fourth winding are nested within respective loops of the third winding.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF DRAWINGS

In the drawings, reference numbers may be reused to identify similar and/or identical elements.

DESCRIPTION

A changing magnetic field passing through a loop, such as a loop of an inductor, induces a current in that loop. The induced current generates an opposing magnetic field. Transformer circuits having inductors and transformers are disclosed below. The inductors, windings (or inductors) of the transformers, and the transformers may have figure eight and/or double figure eight structures. These structures are designed to minimize and/or cancel magnetic coupling between circuit elements and associated induced currents.

An inductor or winding that has a figure eight structure includes at least two loops conductively coupled to each other via a crossover. The at least two loops are non-concentric and separate from each other such that at least one of the loops is not located (or nested) within one of the other loops. An inductor or winding having a double figure eight structure includes at least four loops conductively coupled to each other via at least three crossovers. An inductor or winding having a double figure eight structure has two figure eight structures conductively coupled via a crossover. Examples of inductors and windings having figure eight structures are shown in at least FIGS. 2-12.

A transformer that has a figure eight structure includes at least one winding with a figure eight structure. If the transformer includes multiple windings with figure eight structures, a first winding of the transformer may be nested in a second winding of the transformer. Examples of transformers having figure eight structures are shown in at least FIGS. 2-12.

Magnetic field cancellation provided by the structures of the inductors, windings, and transformers disclosed herein allow for inductors, windings, and transformers to be placed (or nested) in other inductors, windings, and transformers. This minimizes space utilized by the inductors, windings, and transformers. The transformers disclosed herein including those with figure eight structures and double figure eight structures may be vertically stacked transformers, concentric transformers, or other types of transformers. An example of a vertically stacked transformer is shown in FIGS. 13-14. Examples of concentric transformers and/or transformers having concentric loops are shown in FIGS. 2-12.

The transformers disclosed herein may be configured and/or used as baluns. Baluns may refer to electrical transformers that convert first electrical signals, which are balanced relative to a ground reference, to second electrical signals. The second electrical signals are unbalanced relative to the ground reference. Baluns may also convert electrical signals that are unbalanced relative to the ground reference to being balanced relative to a ground reference.

Figure 1:
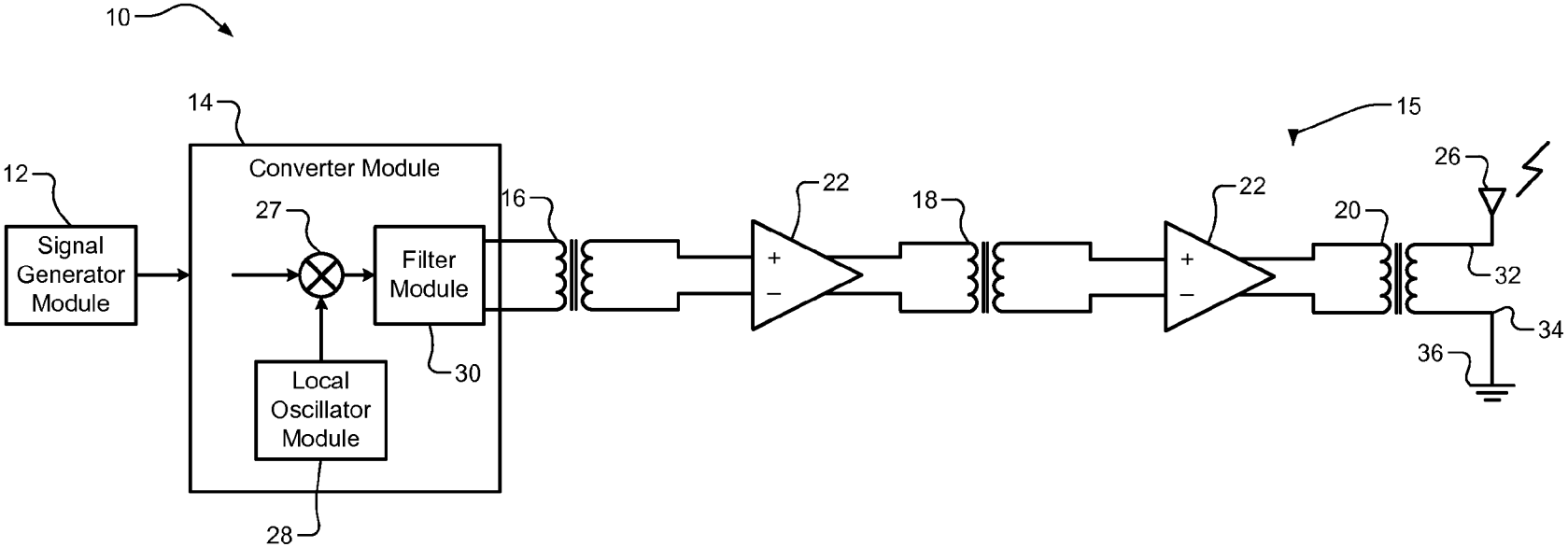
FIG. 1 is a wireless communication circuit incorporating transformers in accordance with the present disclosure.

FIG. 1 shows a wireless communication circuit 10 that includes a signal generator module 12, a converter module 14, a power amplifier circuit 15 with transformers 16, 18, 20 and power amplifiers 22, 24, and an antenna 26. The signal generator module 12 receives and/or generates signals to be transmitted via the antenna 26. The converter module 14 may convert baseband signals to radio frequency (RF) signals. The converter module 14 may include one or more mixers (one mixer 27 is shown), one or more oscillators (one local oscillator 28 is shown), and a filter module 30. The local oscillator 28 generates an oscillating signal. The mixer 27 mixes a signal to be transmitted with the oscillating signal to generate a first output signal. The first output signal is filtered by the filter module 30.

Figure 17:
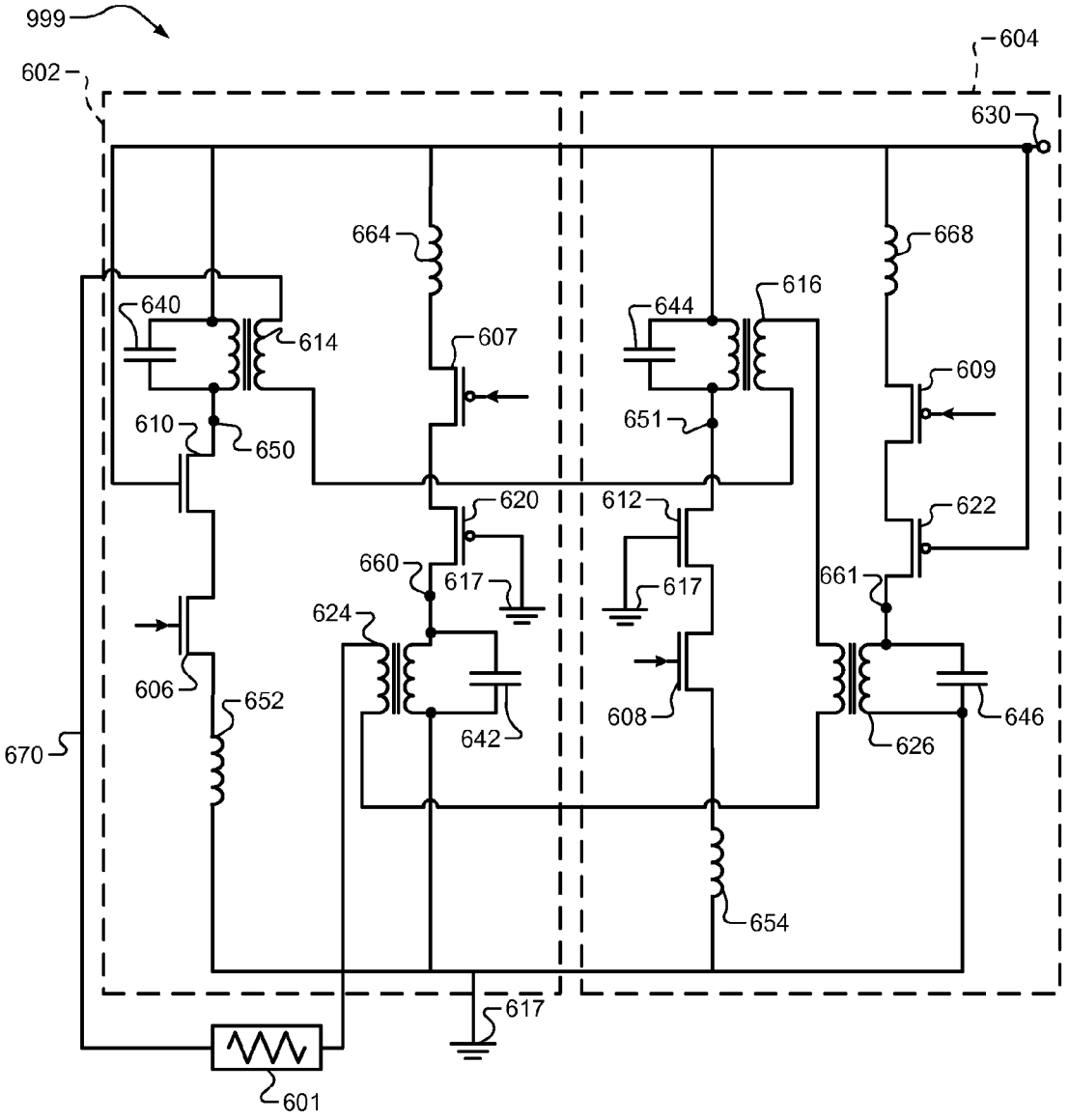
FIG. 17 is a schematic view of a power amplifier circuit incorporating inductors and/or transformers in accordance with the present disclosure.

The transformers 16, 18, 20 and power amplifiers 22, 24 respectively convert and amplify the voltage of the first output signal to generate a second output signal, which is transmitted via the antenna 26. Voltages and/or current levels of the third (or last) transformer 18 may be greater than that of one or more of the other transformers 16, 18, 20 and for at least this reason may be referred to as an aggressor. The other transformers 16, 18 may be referred to as victims. Although a particular number of transformers and power amplifiers are shown, any number of each may be included and/or connected in series, for example, between the converter module 14 and the antenna 26. Each of the transformers 16, 18, 20 may be replaced with any of the transformers disclosed herein. A power amplifier circuit that may be used in replacement of the power amplifier circuit 15 is shown in FIG. 17.

The first output signal and the second output signal may be differential signals. The transformers 16, 18, 20 and power amplifiers 22, 24 may have differential inputs and outputs as shown for receiving and transmitting the differential signals. The third transformer 18 has a differential output with a first output terminal 32 and a second output terminal 34. The first output terminal 32 of the third transformer 18 is connected to the antenna 24. The second output terminal 34 of the third transformer 18 is connected to a ground reference 36.

One or more of the transformers 16, 18, 20 may have a figure eight structure to maximize cancellation of inductive and magnetic coupling between inductors and/or transformers and to minimize circuit characteristics. The circuit characteristics may include local oscillator pulling, crosstalk between circuit components, and feedback between power amplifiers. In addition, the transformers 16, 18, 20 may have preselected orientations relative to each other to further maximize cancellation of inductive and magnetic coupling and minimize circuit characteristics. For example, distances having the same length may exist between (i) centers of loops of the aggressor, and (ii) centers of loops of one of the victims. This provides an equal amount of inductive and/or magnetic coupling between (i) the loops of the aggressor, and (ii) the loops of the victim. This is further described with respect to FIGS. 2-3.

Figure 2:
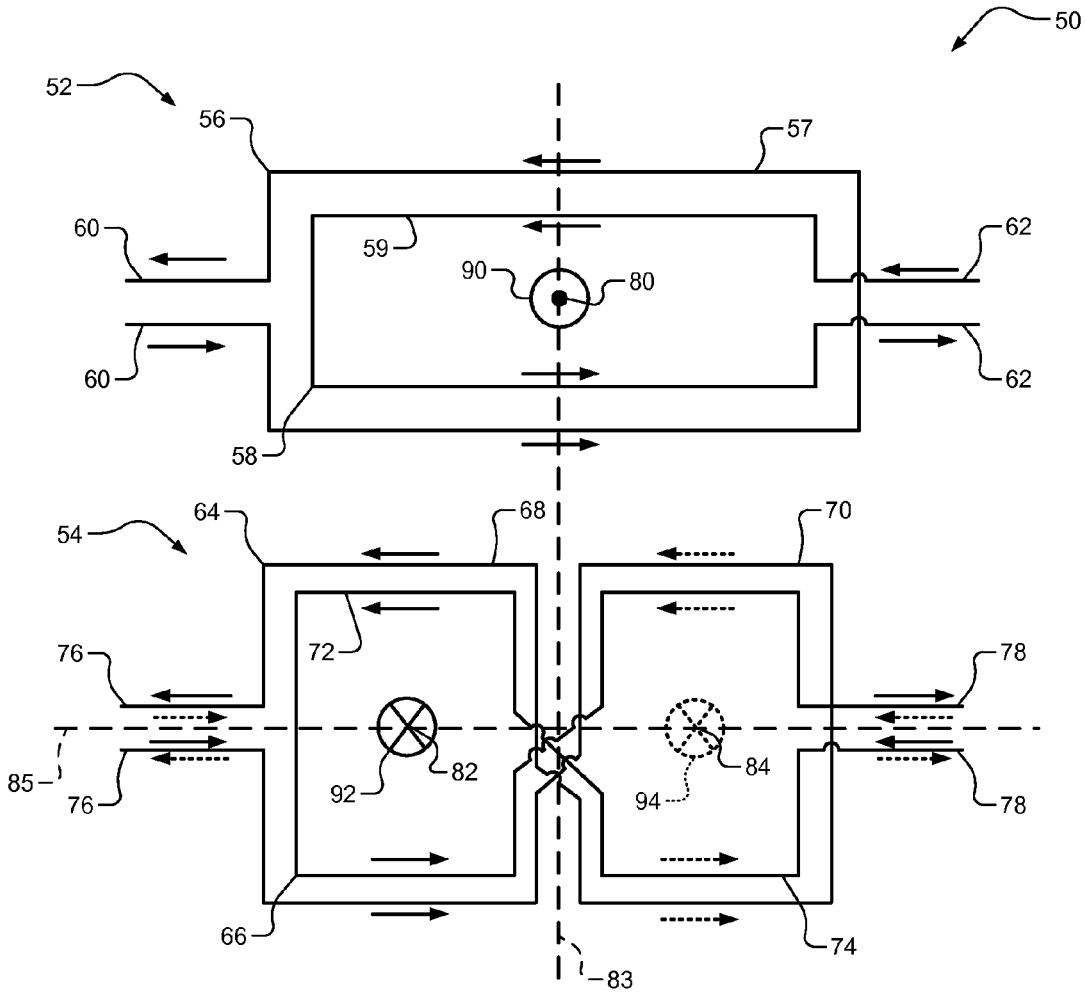
FIG. 2 is a schematic view of a transformer circuit illustrating inductive coupling between a first transformer (or aggressor) and a second transformer (or victim), where the victim has a figure eight structure with loops connected in series.

FIG. 2 shows a transformer circuit 50 that includes an aggressor (or first transformer) 52 and a victim (or second transformer) 54. Although the aggressor 52 is shown as having a non-figure eight structure and the victim 54 is shown as having a figure eight structure, the aggressor 52 may have a figure eight structure and the victim 54 may have a non-figure eight structure. Alternatively, both the aggressor 52 and the victim 54 may both have figure eight structures. The aggressor 52 includes a first (or primary) winding 56 with a loop 57 and a second (or secondary winding) 58 with a loop 59. The secondary winding 58 may be nested within the primary winding 56 as shown. The primary winding 56 has input terminals 60. The secondary winding 58 has output terminals 62.

The victim 54 has a third (or primary) winding 64 and a fourth (or secondary) winding 66. Each of the windings 64, 66 has a figure eight structure. The third winding 64 has two loops 68, 70. The fourth winding 66 has two loops 72, 74 that are nested respectively in the loops 68, 70. The third winding 64 has input terminals 76. The fourth winding 66 has output terminals 78. The loops 68, 72 are connected in series respectively with the loops 70, 74 between the input terminals 76 and the output terminals 78. The loop 68 is connected to and conductively coupled with the loop 70 via a first crossover 79. The loop 72 is connected to and conductively coupled with the loop 74 via a second crossover 81. Each of the crossovers 79, 81 has a pair of conductors. Each of the conductors in the crossovers 79, 81 cross each other to connect to two of the loops 68, 70, 72, 74.

The loops 57, 59 of the aggressor 52 may be concentric and have a first center 80. The loops 68, 70 of the third winding 64 are concentric with respective loops 72, 74 of the fourth winding 66. The loops 68, 72 of the victim 54 have a second center 82. The loops 70, 74 of the victim 54 have a third center 84.

The amount of magnetic coupling cancellation between the aggressor 52 and the victim 54 depends on the sizes and shapes of the loops 68, 70, 72, 74 and orientations of the loops 68, 70, 72, 74 relative to the aggressor 52. The loops of the loops 68, 70, 72, 74 are sized and positioned to maximize cancellation of currents generated from inductive and/or magnetic coupling between the aggressor 52 and the victim 54. The loops 68, 70 are symmetric about a vertical axis 83, are the same size, and are equidistant from the transformer 52, the windings 56, 58, the loops 57, 59, and/or the center 80. The vertical axis 83 extends through the center 80 and the crossovers 79, 81. The loops 72, 74 are symmetric about the vertical axis 83, are the same size, and are equidistant from the transformer 52, the windings 56, 58, the loops 57, 59, and/or the center 80. A first distance between the centers 80, 82 is equal to a second distance between the centers 80, 84. Rotation of the victim 54 relative to the aggressor 52 such that the second distance is different than the first distance decreases the amount of cancellation. The greater the difference between the first distance and the second distance the less cancellation. A small amount of attenuation and/or cancellation in magnetic coupling and/or amount of induced currents improves circuit performance.

During operation, the aggressor 52 generates a first magnetic field that is directed in a first direction, represented by symbol 90. The generated magnetic field 90 induces currents in the loops 68, 70, 72, 74 of the victim 54. The currents generated in the loops 68, 70, 72, 74 of the victim 52 generate respective magnetic fields represented by symbols 92, 94. The magnetic fields 92, 94 are directed in a second direction. The second direction is opposite the first direction. The currents inductively generated in the loops 68, 72 (represented by solid arrows) cancel the currents inductively generated in the loops 70, 74 (represented by dashed arrows).

The transformer 54 cancels out interference or induced current generated by the transformer 52 along the vertical axis 83. Interference and induced current is also cancelled along a horizontal axis 85 passing through the centers 82, 84. Similar cancellations are also provided by the other transformers disclosed herein.

Figure 3:
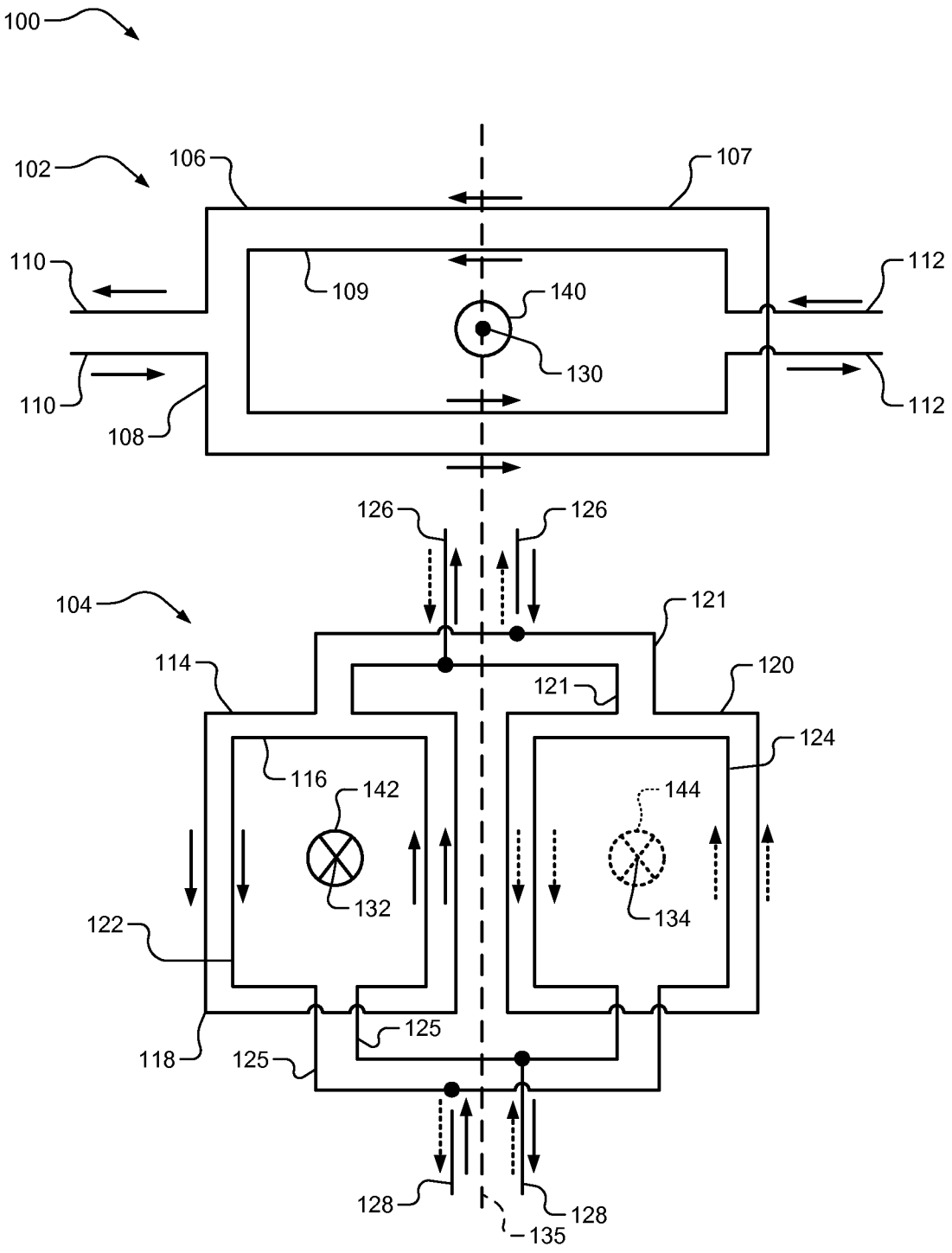
FIG. 3 is a schematic view of a transformer circuit illustrating inductive coupling between a first transformer (or aggressor) and a second transformer (or victim), where the victim has a figure eight structure with loops connected in parallel.

FIG. 3 shows a transformer circuit 100 that includes an aggressor (or first transformer) 102 and a victim (or second transformer) 104. The aggressor 102 has a non-figure eight structure. The victim 104 has a figure eight structure. The aggressor 102 includes a first (or primary) winding 106 with a loop 107 and a second (or secondary winding) 108 with a loop 109. The secondary winding 108 may be nested within the primary winding 106 as shown. The primary winding 106 has input terminals 110. The secondary winding 108 has output terminals 112.

The victim 104 has a third (or primary) winding 114 and a fourth (or secondary) winding 116. Each of the windings 114, 116 has a figure eight structure. The third winding 114 has two loops 118, 120. The fourth winding 116 has two loops 122, 124 that are nested respectively in the loops 118, 120. The loops 118, 120 are connected to each other via parallel conductors 121. The parallel conductors are connected to input terminals 126. The loops 122, 124 are connected to each other via parallel conductors 125. The parallel conductors 125 are connected to output terminals 128. The loops 118, 122 are connected in parallel respectively with the loops 120, 124 between the input terminals 126 and the output terminals 128.

The loops 107, 109 of the aggressor 102 may be concentric and have a first center 130. The loops 118, 120 of the third winding 114 are concentric with respective to the loops 122, 124 of the fourth winding 116. The loops 118, 122 of the victim 104 have a second center 132. The loops 120, 124 of the victim 104 have a third center 134.

The loops 118, 120 are symmetric about a vertical axis 135, are the same size, and are equidistant from the transformer 102, the windings 106, 108, the loops 107, 109, and/or the center 130. The vertical axis 135 extends through the center 130 and between the loops 118, 120. The loops 122, 124 are symmetric about the vertical axis 135, are the same size, and are equidistant from the transformer 102, the windings 106, 108, the loops 107, 109, and/or the center 130. To maximize cancellation of currents generated from inductive and/or magnetic coupling between the aggressor 102 and the victim 104, a first distance between the centers 130, 132 is equal to a second distance between the centers 130, 134. Rotation of the victim 104 relative to the aggressor 102 such that the second distance is different than the first distance decreases the amount of cancellation. The greater the difference between the first distance and the second distance the less cancellation.

During operation, the aggressor 102 generates a first magnetic field that is directed in a first direction, represented by symbol 140. The generated magnetic field 140 induces currents in the loops 118, 120, 122, 124 of the victim 104. The currents generated in the loops 118, 120, 122, 124 of the victim 104 generate respective magnetic fields represented by symbols 142, 144. The magnetic fields 142, 144 are directed in a second direction. The second direction is opposite the first direction. The currents inductively generated in the loops 118, 122 (represented by solid arrows) cancel the currents inductively generated in the loops 120, 124 (represented by dashed arrows).

Figure 4:
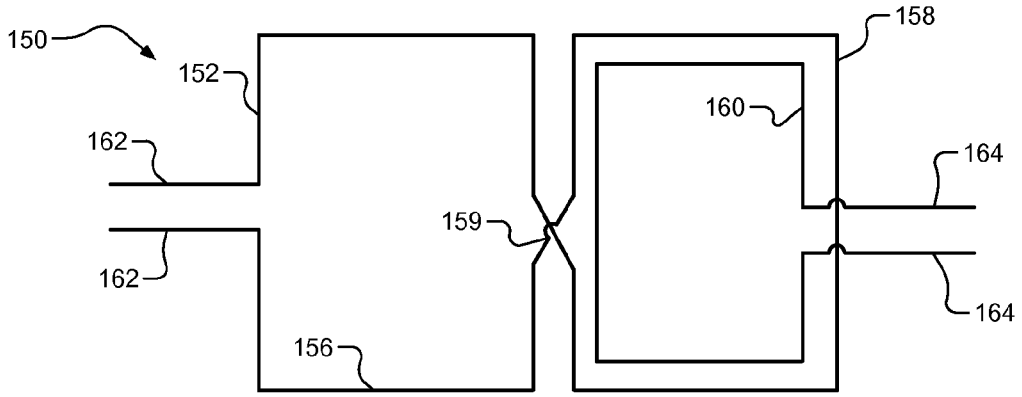
FIG. 4 is a schematic view of a transformer having a winding nested in a loop of another winding.

FIG. 4 shows a transformer 150 having a first winding 152 and a second winding 154. The first winding 152 is magnetically and inductively coupled to the second winding 154. The first winding 152 has a figure eight structure with loops 156, 158 and a crossover 159. The second winding 154 has a single loop 160 and is nested in the second loop 158 of the first winding 152. The loop 160 may be concentric with the second loop 158. The first winding 152 has input terminals 162. The second winding 154 has output terminals 164 opposite (i.e. on an opposite side of the transformer 150 and across from) the input terminals 162.

Figure 5:
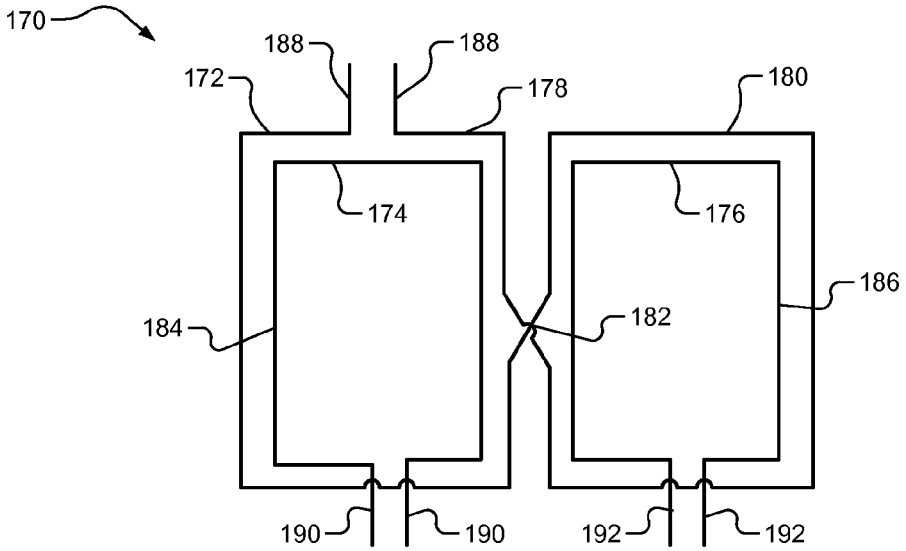
FIG. 5 is a schematic view of a transformer having multiple windings nested in respective loops of a single winding and opposing input and output terminals.

FIG. 5 shows a transformer 170 having a first winding 172, a second winding 174, and a third winding 176. The first winding 172 is magnetically and inductively coupled to the windings 174, 176. The first winding 172 has a figure eight structure with loops 178, 180 and a crossover 182. The second winding 174 has a single loop 184 and is nested in the first loop 178 of the first winding 172. The third winding 176 has a single loop 186 and is nested in the second loop 180 of the first winding 172. The loop 184 of the second winding 174 may be concentric with the first loop 178. The loop 186 of the third winding 176 may be concentric with the second loop 180.

The first winding 172 has input terminals 188. The second winding 174 has first output terminals 190 that are opposite the input terminals 188. The third winding 176 has second output terminals 192 that are on an opposite side of the transformer 170 as the input terminals 188, but are not directly across from the input terminals 188.

Figure 6:
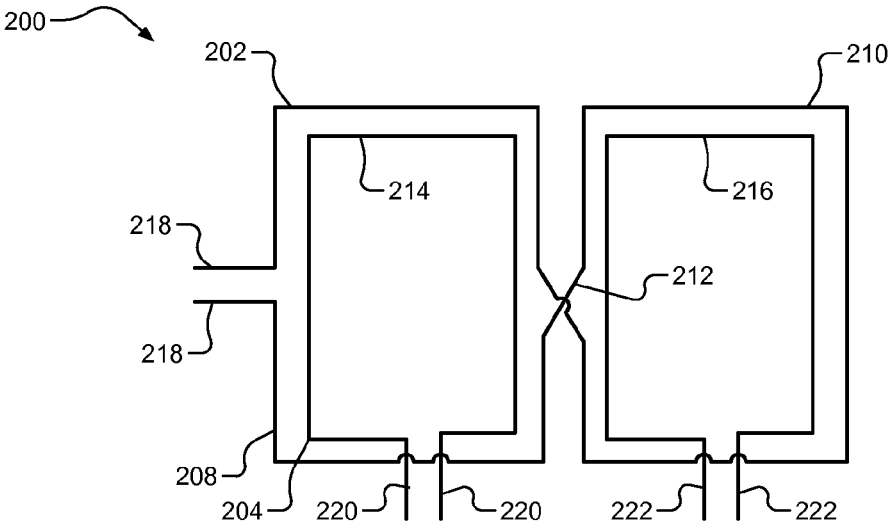
FIG. 6 is a schematic view of a transformer having multiple windings nested in respective loops of a single winding and non-opposing input and output terminals.

FIG. 6 shows a transformer 200 having a first winding 202, a second winding 204, and a third winding 206. The first winding 202 is magnetically and inductively coupled to the windings 204, 206. The first winding 202 has a figure eight structure with loops 208, 210 and a crossover 212. The second winding 204 has a single loop 214 and is nested in the first loop 208 of the first winding 202. The third winding 206 has a single loop 216 and is nested in the second loop 210 of the first winding 202. The loop 214 of the second winding 204 may be concentric with the first loop 208. The loop 216 of the third winding 206 may be concentric with the second loop 210.

The first winding 202 has input terminals 218. The second winding 204 has first output terminals 220 that are on a different side of the transformer 200 than the input terminals 218 and are not opposite the input terminals 218. The third winding 206 has second output terminals 222 that are on a different side of the transformer 200 than the input terminals 218 and are not opposite the input terminals 218.

Although the input terminals and output terminals disclosed herein are on certain sides of transformers, the input terminals and output terminals may be on other sides of the transformers. Also, each inductor, winding and/or transformer disclosed herein may have any number of input terminals and/or output terminals.

The magnetic cancellation provided by the figure eight structure of a transformer allows transformers to be nested in other transformers while maintaining a certain degree of isolation between the transformers. This minimizes space utilized by the transformers, which is especially beneficial when the transformers are implemented in an integrated circuit (or chip).

Figure 7:
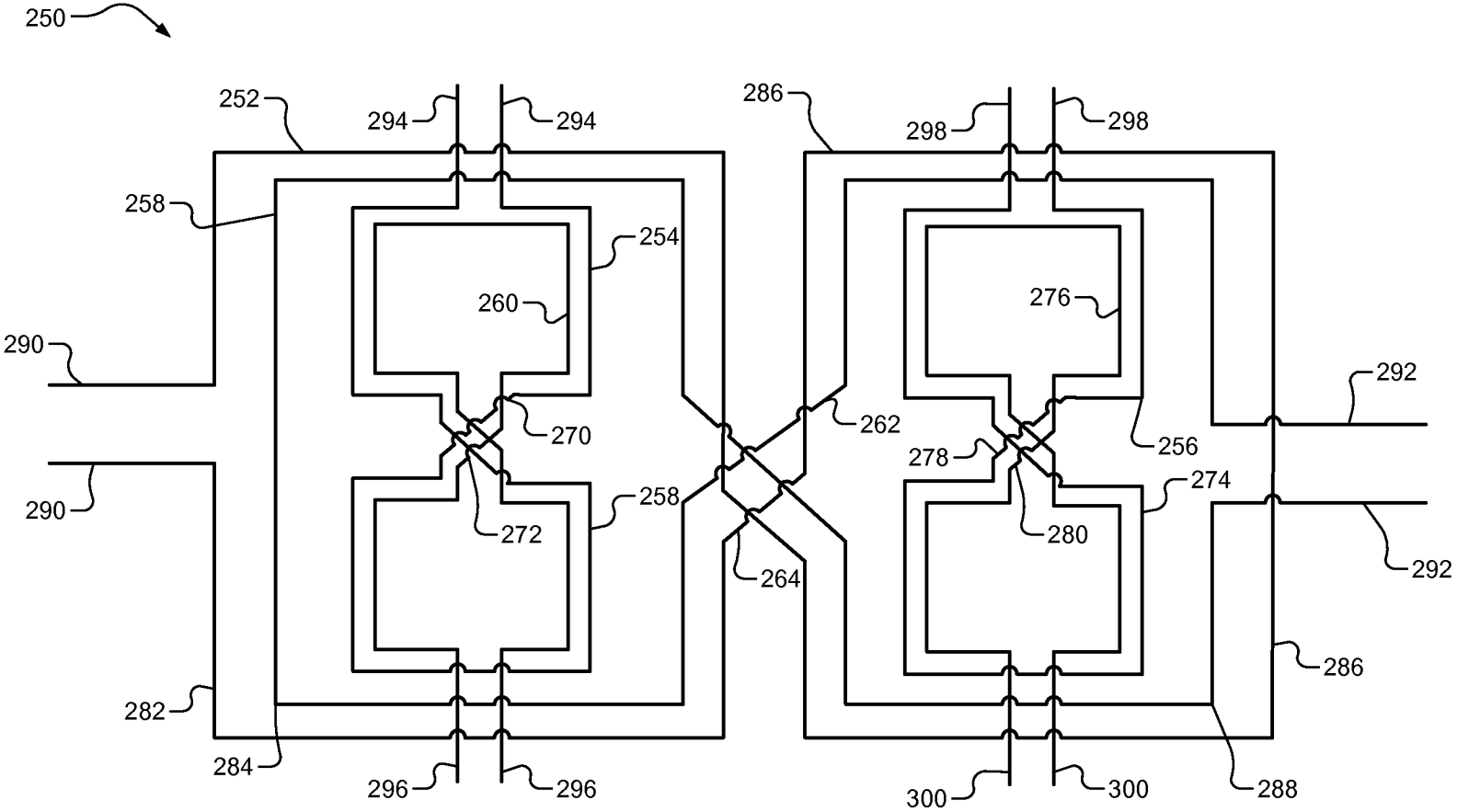
FIG. 7 is a schematic view of a transformer circuit incorporating multiple transformers with figure eight structures nested in respective loops of a transformer.

FIG. 7 shows a transformer circuit 250 that includes a first transformer 252, a second transformer 254, and a third transformer 256. Each of the transformers 252, 254, 256 has a figure eight structure. The transformers 252, 254, 256 may be magnetically and inductively coupled. However, currents generated due to this coupling may be minimized and/or cancelled because of the figure eight structures of the transformers 252, 254, 256 and the relative placement of the transformers 252, 254, 256. The transformer 252 has windings 258, 260 and crossovers 262, 264. The windings 258, 260 are magnetically and inductively coupled to each other. The transformer 254 has windings 258, 260 and crossovers 270, 272. The windings 266, 268 are magnetically and inductively coupled to each other. The transformer 256 has windings 274, 276 and crossovers 278, 280. The windings 274, 276 are magnetically and inductively coupled to each other. The second transformer 254 is nested in loops 282, 284 of the first transformer 252. The third transformer 256 is nested in loops 286, 288 of the first transformer 252. Each of the windings 258, 260, 266, 268, 274, 276 has a figure eight structure.

The first transformer 252 has input terminals 290 and output terminals 292 that are opposite the input terminals 290. The second transformer 254 has input terminals 294 and output terminals 296 that are opposite the input terminals 294. The third transformer 256 has input terminals 298 and output terminals 300 that are opposite the input terminals 298. The terminals 290, 292 are on different sides of the first transformer 252 than the terminals 294, 296, 298, 300. The terminals 294, 298 are on the same side of the first transformer 252.

Figure 8:
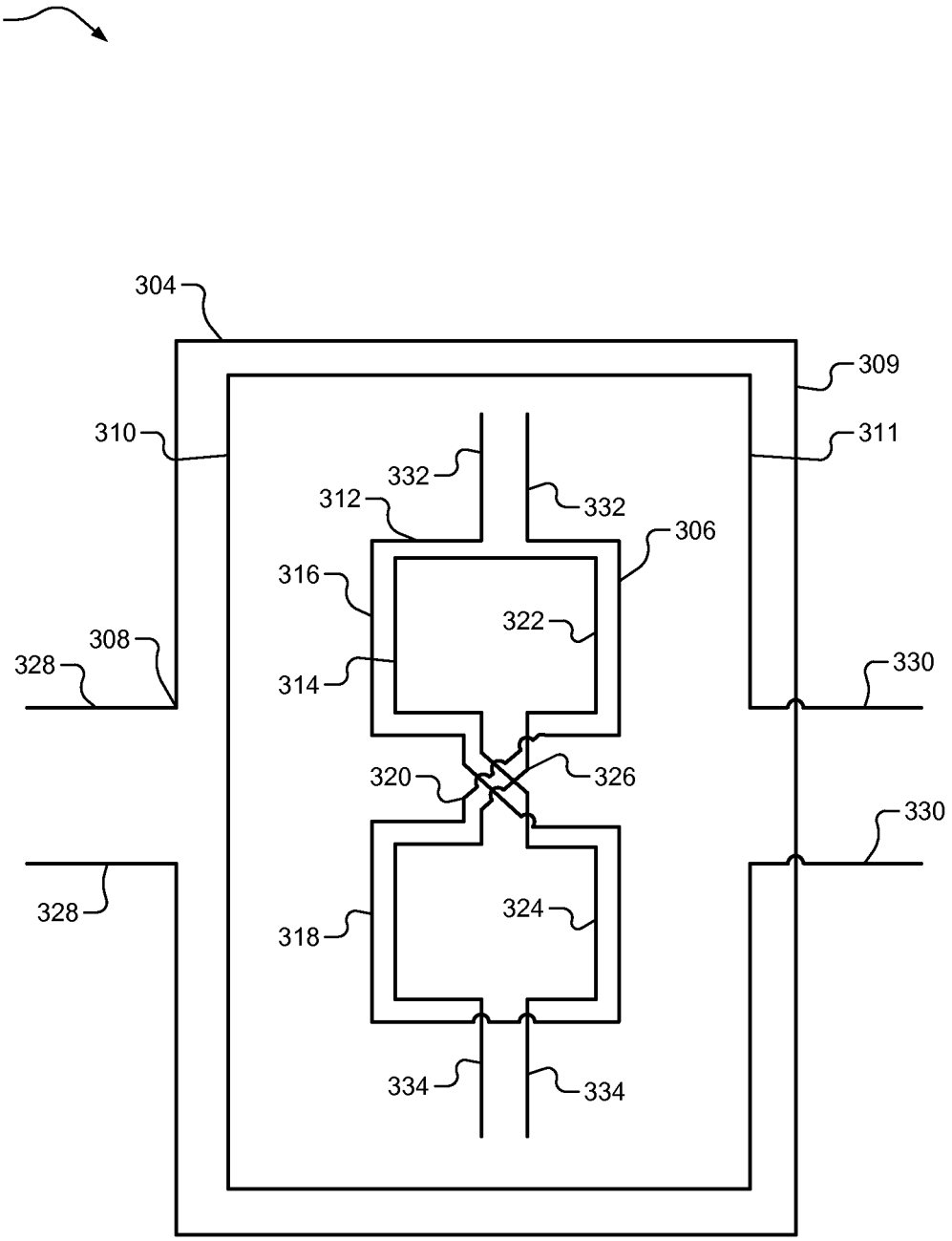
FIG. 8 is a schematic view of a transformer circuit incorporating a transformer having a figure eight structure nested in another transformer with a non-figure eight structure.

FIG. 8 shows a transformer circuit 302 that has a first transformer 304 and a second transformer 306. The first transformer 304 has a non-figure eight structure. The second transformer 306 has a figure eight structure and is nested in the first transformer 304. The transformers 304, 306 may be magnetically and inductively coupled. However, currents generated in the second transformer 306 due to this coupling may be minimized and/or cancelled by the figure eight structure of the second transformer 306 and/or the placement of the second transformer 306 relative to the first transformer 304.

The first transformer has a first winding 308 with a first loop 309 and a second winding 310 with a second loop 311. The first winding 308 is magnetically and inductively coupled to the second winding 310. The second transformer 306 is nested within the loops 309, 311 of the first transformer 304. The second transformer 306 includes a first winding 312 and a second winding 314. The first winding 312 is magnetically and inductively coupled to the second winding 314. Each of the windings 312, 314 has a figure eight structure. The first winding 312 has loops 316, 318 and a crossover 320. The second winding 314 has loops 322, 324 and a crossover 326.

The first transformer 304 has input terminals 328 and output terminals 330 that are opposite the input terminals 328. The second transformer 306 has input terminals 332 and output terminals 334 opposite the input terminals 332. The terminals 328, 330 are on different sides of the first transformer 304 than the terminals 332, 334.

The loops 316, 318 are conductively coupled to each other. The loops 316, 318 are not nested in each other. The loops 322, 324 are conductively coupled to each other. The loops 322, 324 are not nested in each other. The structure of the transformer 306 is similar to the structures of the transformers 254, 256 of FIG. 7. As such, the loops of the windings 266, 268, 274, 276 of the transformers 254, 256 have similar relationships as the loops 316, 318, 322, 324 of the transformer 306.

Figure 9:
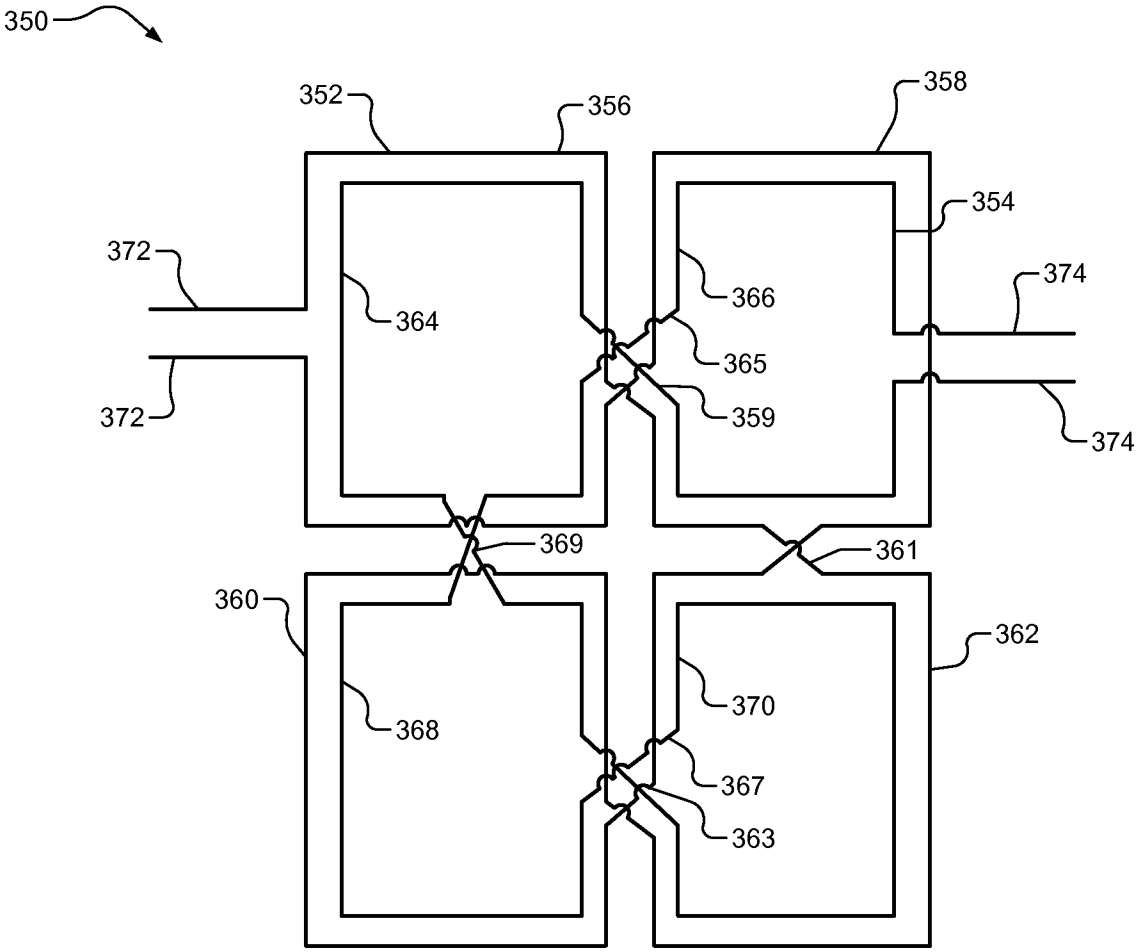
FIG. 9 is a schematic view of a transformer having a double figure eight structure.

FIG. 9 shows a transformer 350 that has a double figure eight structure. The double figure eight structure mitigates dependence of magnetic cancellation on the orientation of a figure eight structure. The transformer 350 includes a first winding 352 and a second winding 354. The first winding 352 is magnetically and inductively coupled to the second winding 354. Each of the windings 352, 354 has a double figure eight structure. The first winding has loops 356, 358, 360, 362 and crossovers 359, 361, 363. The second winding has loops 364, 366, 368, 370 and crossovers 365, 367, 369. Each of the loops 364, 366, 368, 370 may be concentric with and/or nested in a respective one of the loops 364, 366, 368, 370. The first winding 352 has input terminals 372. The second winding 354 has output terminals 374. The input terminals 352 may be on the same, different, and/or opposite side of the transformer 350 than the output terminals 374.

The loops and crossovers of the first winding 352 are connected in series. The loops and crossovers of the second winding 354 are connected in series. Although each of the windings 352, 354 are shown for the double figure eight structure as having four loops and three crossovers, in other implementations, each of the windings may have fewer loops and crossovers or additional loops and crossovers. If fewer loops and crossovers are included, then the corresponding structure is not a double figure eight structure. If additional loops and crossovers are included, then the structure may have a double figure eight structure depending on the layout of the loops and crossovers.

None of the loops 356, 358, 360, 362 is nested within any other one of the loops 356, 358, 360, 362. The loops 356, 358, 360, 362 are conductively coupled to each other. None of the loops 364, 366, 368, 370 is nested within any other one of the loops 364, 366, 368, 370. The loops 364, 366, 368, 370 are conductively coupled to each other. The double figure eight structure provides magnetically induced current cancellation in all directions, regardless of the orientation of the structure of the transformer 350 relative to other inductors and/or transformers.

Figure 10:
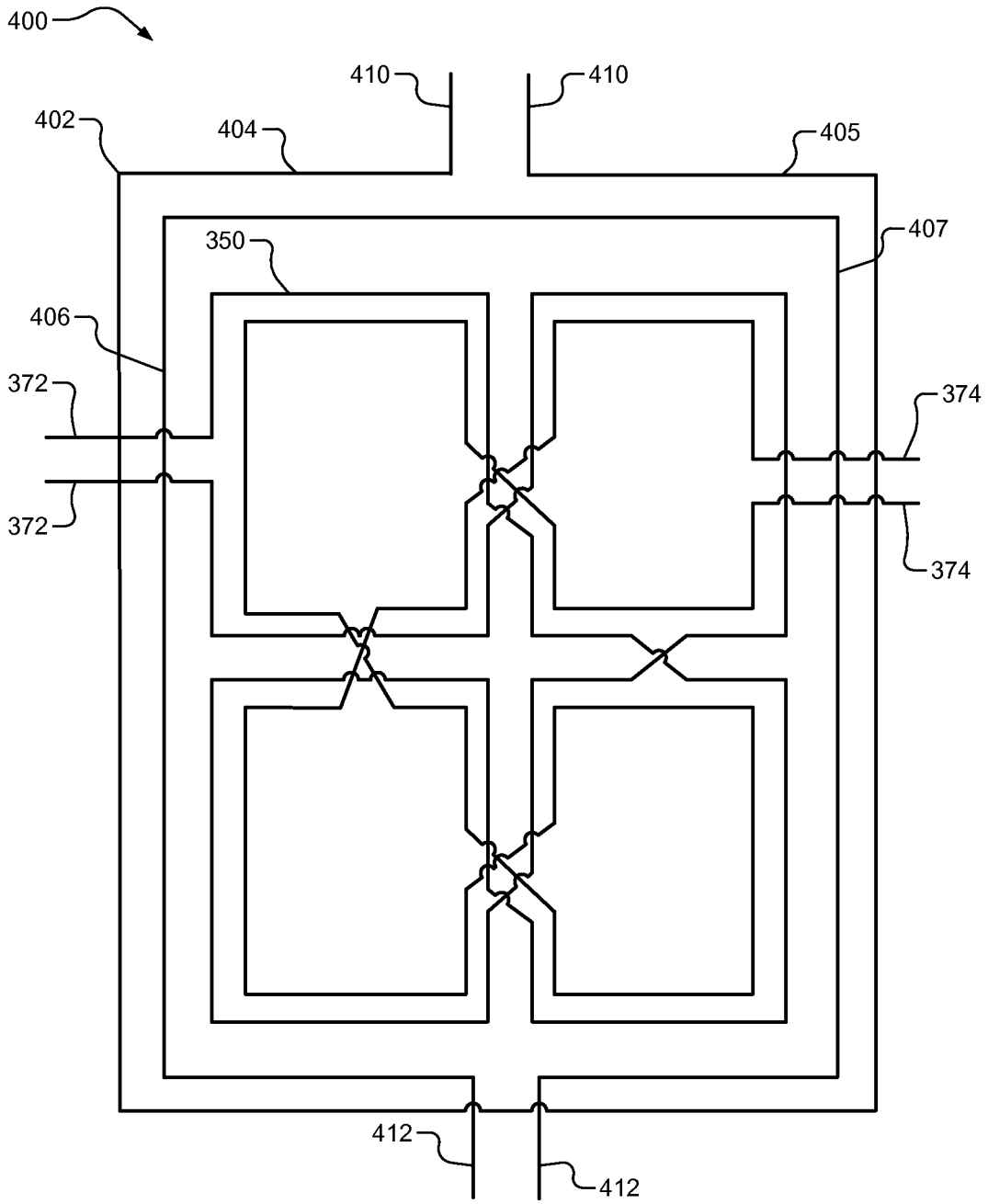
FIG. 10 is a schematic view of a transformer circuit including a transformer having a double figure eight structure nested within another transformer having a non-figure eight structure.

Referring now also to FIG. 10, which shows a transformer circuit 400. The transformer circuit 400 includes the transformer 350 nested in another transformer 402. The transformer 402 has a first winding 404 with a first loop 405 and a second winding 406 with a second loop 407. The first winding 404 is magnetically and inductively coupled to the second winding 406. The second loop 407 is nested within and may be concentric with the first loop 405. The transformer 350 is nested within the second loop 407. The first winding 404 has input terminals 410. The second winding 406 has output terminals 412 opposite the input terminals 410. The terminals 410, 412 are on different sides and loops of the transformer 402 than the terminals 372, 374 of the transformer 350.

Figure 11:
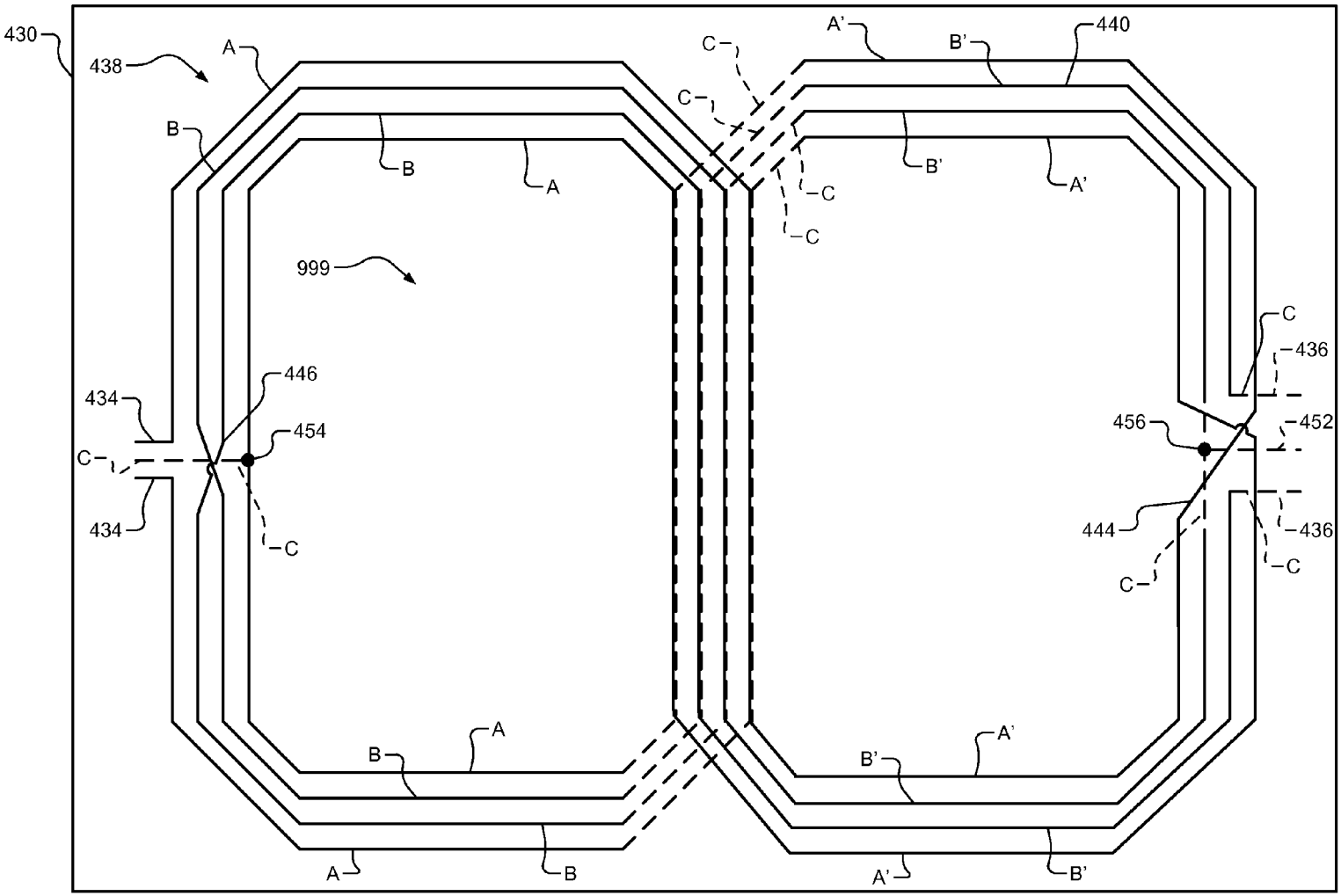
FIG. 11 is a top view of an integrated circuit illustrating a layout of a transformer having a figure eight structure and opposing input and output terminals.

FIG. 11 shows an integrated circuit (IC) 430 illustrating a layout of a transformer 432. The transformer 432 has a figure eight structure and input terminals 434 that are opposite output terminals 436. The transformer 432 has a first winding 438 and a second winding 440. Each of the windings 438, 440 have two overlapping figure eight structures. The first winding 438 has four loops with eight sections A and A'. The second winding 440 has four loops with eight sections B and B'. Each of the windings 438, 440 also has a respective one of crossovers 444, 446, which are on opposite sides of the transformer 432. The crossover 444 of the first winding 438 is on an opposite side of the transformer 432 as the input terminals 434. The crossover 446 is on an opposite side of the transformer 432 as the output terminals 436.

Portions C (shown with dashed lines) of the windings 438, 440 are on a different layer of the IC 430 than other portions (shown with solid lines) of the windings 438, 440. The portions C may be on a first layer and the other portions of the windings 438, 440 may be on a second layer. An insulation layer may be disposed between the first layer and the second layer. The portions C may be connected to the other portions by via or other suitable conductors in the insulation layer. This allows the portions C to overlap sections of the other portions without contacting these sections, which reduced space utilized by the transformer 432.

As an example, the sections A, B may be on a first metal layer. The sections C may be on a second metal layer. The second A', B' may be on a third metal layer. Any number of insulation layers may be between the first metal layer and the second metal layer and between the second metal layer and the third metal layer. The second metal layer may be disposed between the first metal layer and the third metal layer. The segments of the crossovers 444, 446 associated with the sections A, A' may be on different layers than the segments of the crossovers 444, 446 associated with the second B, B'.

The transformer 432 may also include center tap terminals 450, 452, which may be connected to center taps 454, 456. The center taps 454, 456 are connected to center points of the windings 438, 440. As an example, the center points of the windings 438, 440 may be voltage biased via the center tap terminals 450, 452.

Figure 12:
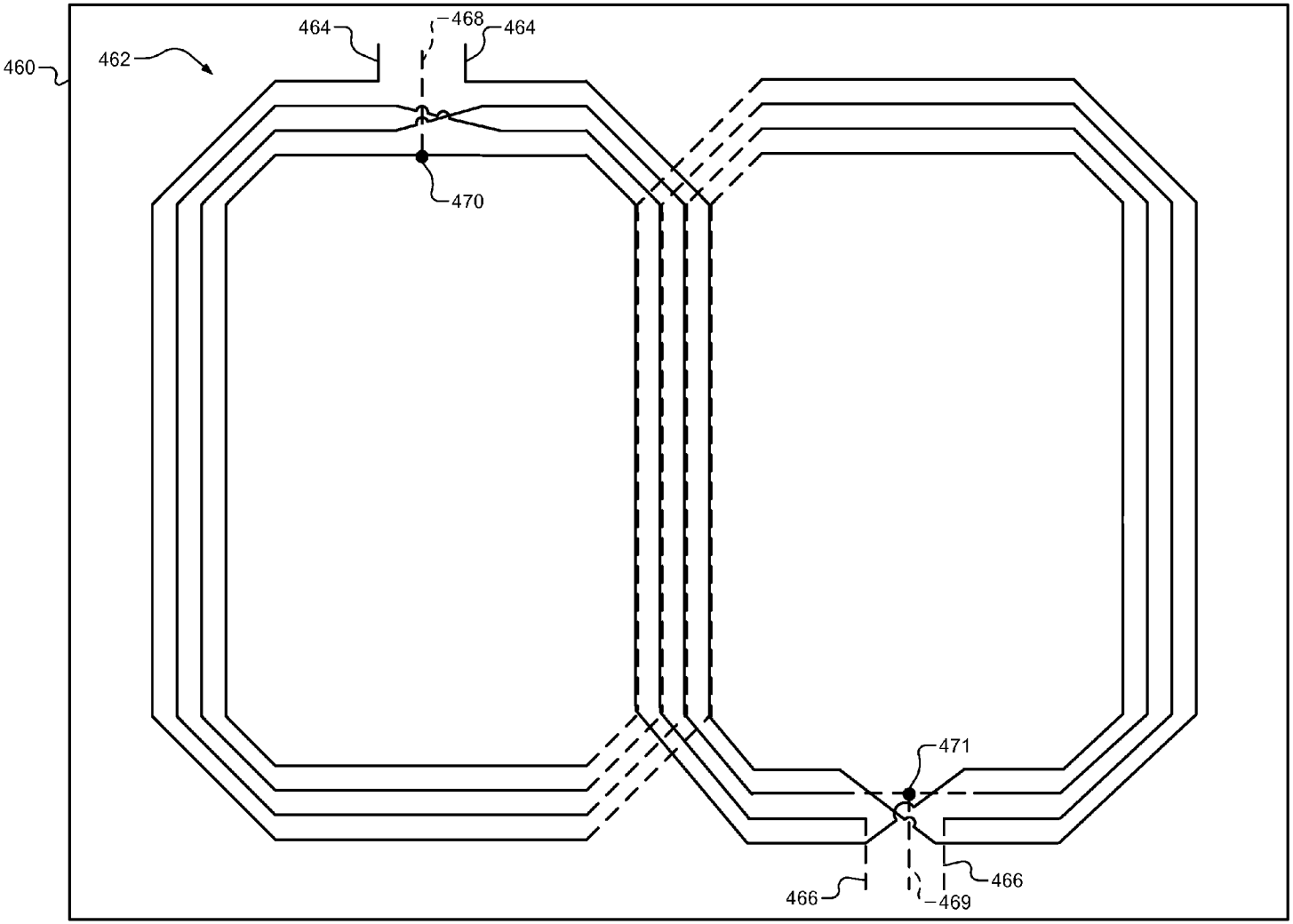
FIG. 12 is a top view of an integrated circuit illustrating a layout of a transformer having a figure eight structure and non-opposing input and output terminals.
Figure 13:
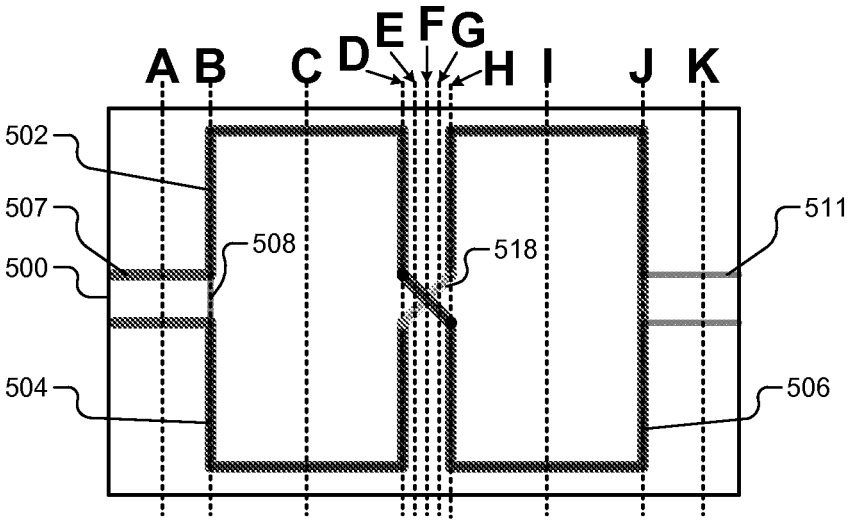
FIG. 13 is a top view of an integrated circuit illustrating a transformer having a figure eight structure and vertically stacked loops.
Figure 14A:
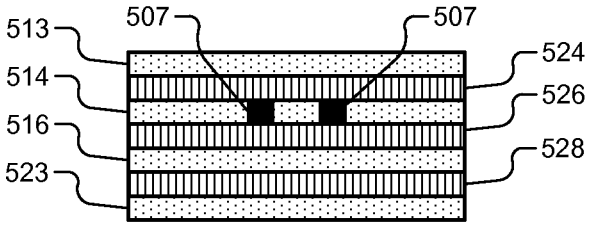
FIGS. 14A-K are cross-sectional side views along section lines A-K of the integrated circuit of FIG. 13.
Figure 14B:
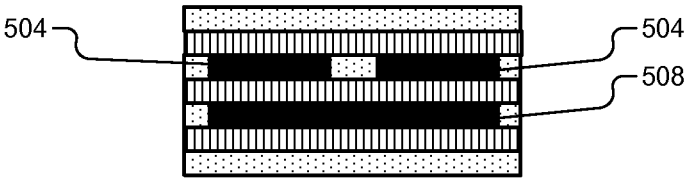
Figure 14C:
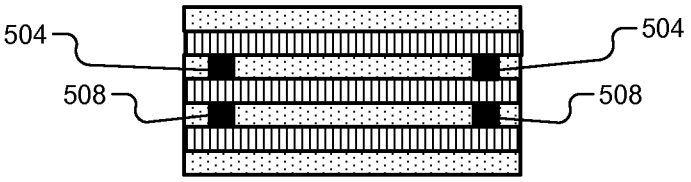
Figure 14D:
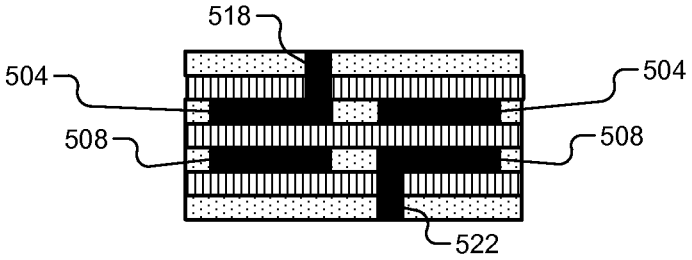
Figure 14E:
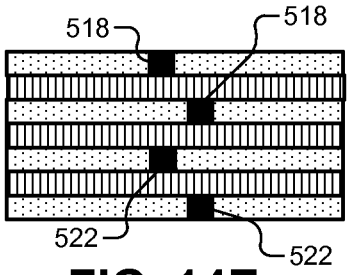
Figure 14F:
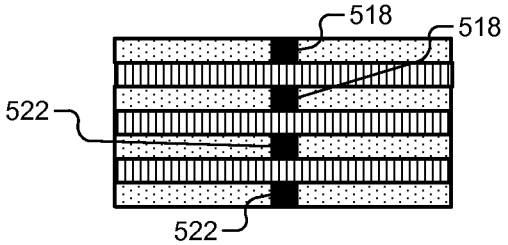
Figure 14G:
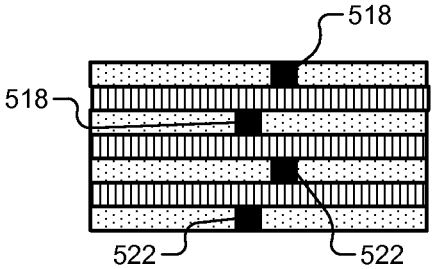
Figure 14H:
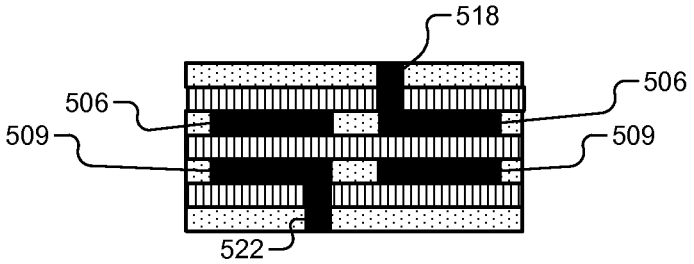
Figure 14I:
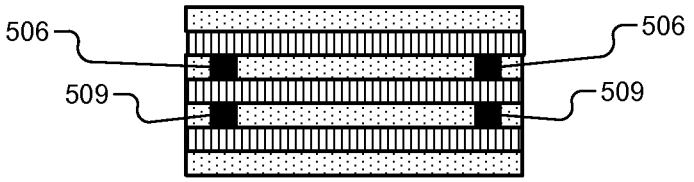
Figure 14J:
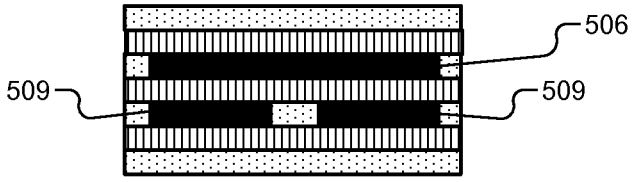
Figure 14K:
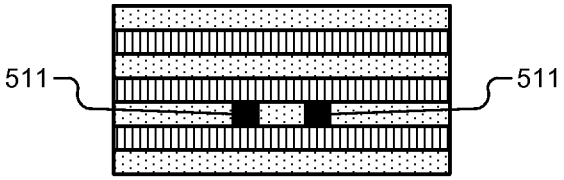

FIG. 12 shows an IC 460 illustrating a layout of a transformer 462. The transformer 462 has a similar structure as the transformer 432 of FIG. 11, except positions of input terminals 464, output terminals 466, center tap terminals 468, 469, and center taps 470, 471 are different than that of the transformer 432. The terminals 464, 468 and the center tap 470 are on a different sides and loops of the transformer 462 than the terminals 466, 469 and the center tap 471, but are not opposite the terminals 466, 469 and the center tap 471.

FIGS. 13 and 14A-K show top and cross-sectional side views of an IC 500 illustrating a transformer 502 having a figure eight structure and vertically stacked loops 504, 506 and 508, 509. The stacked figure eight structure of FIGS. 13 and 14A-K may replace any other figure eight structure disclosed herein and/or the other embodiments disclosed herein may be modified to incorporate stacked loops and/or crossovers similar to the transformer 502.

The IC 500 may have any number of layers and circuit components. As shown, the IC 500 has seven layers 510, which may be disposed on a substrate of the IC 500. The transformer 502 has a first winding with the loops 504, 506 and input terminals 507 and a second winding with the loops 508, 509 and output terminals 511. The loop 504 is stacked on the loop 508. The loop 506 is stacked on the loop 509.

A first crossover 518 of the first winding is located on a first (or first outer) metal layer 513. The loop 504, 506 are located on a second (or first inner) metal layer 514. The loops 508, 509 are located on a third (or second inner) metal layer 516. A second crossover 522 of the second winding is located on a fourth (or second outer) metal layer 523. The metal layers 514, 516 are disposed between the metal layers 513, 523 to separate the crossovers 518, 522. Insulation (or via) layers 524, 526, 528 are located respectively between the metal layers 513, 514, 516, 523. The loop 504 is connected to the loop 506 via the crossover 518. The loop 508 is connected to the loop 509 via the crossover 522.

Figure 15:
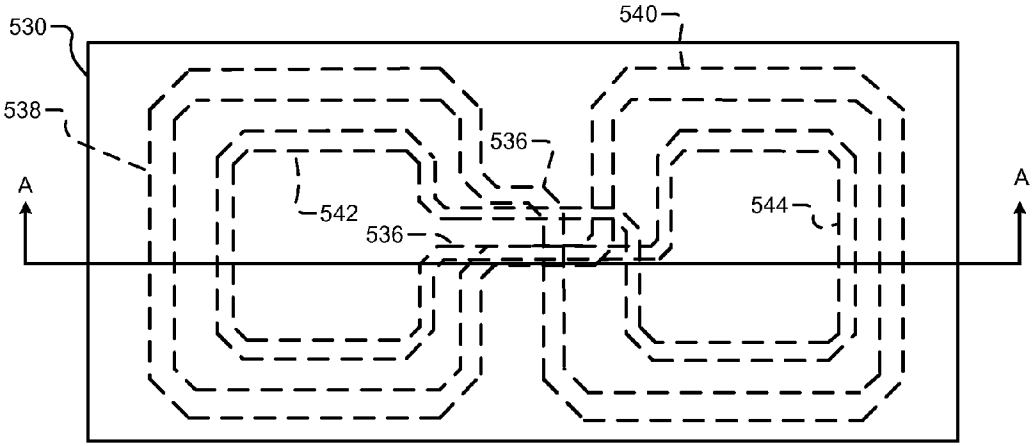
FIG. 15 is a top view of an integrated circuit illustrating a transformer having a figure eight structure with crossovers and loops on different layers.
Figure 16:
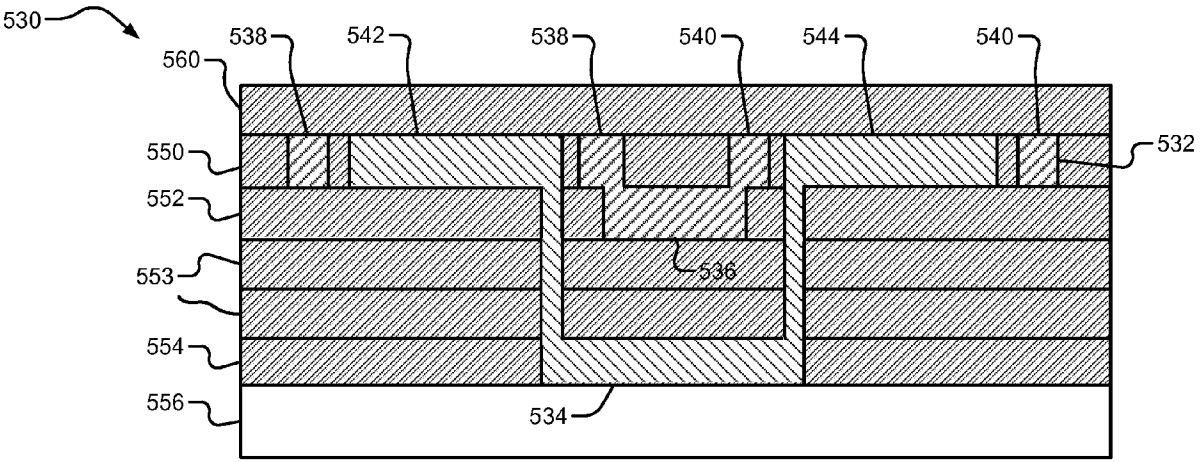
FIG. 16 is a cross-sectional side view along section line A-A of the integrated circuit of FIG. 14.

FIGS. 15-16 show top and cross-sectional side views of an IC 530 illustrating a transformer 532 having a figure eight structure and crossovers 534, 536 and loops 538, 540, 542, 544 on different layers. The figure eight structure of FIGS. 15-16 may replace any other figure eight structure disclosed herein and/or the other embodiments disclosed herein may be modified to include crossovers on different layers than loops similar to the transformer 532.

The transformer 532 has a first winding with the loops 538, 540 and crossover 534 and the second winding with the loops 542, 544 and the crossover 536. The loops 538, 540, 542, 544 are on a first layer 550. The crossover 536 is on a second layer 552. The crossover 534 is on the second and third layers 554. The crossovers 534, 536 may both be on the same layer, may be on different layers, and/or may be on multiple layers. The first crossover 534 is not conductively coupled to the second crossover 536.

The first layer 550 may be disposed on the second layer 552. The second layer 552 may be disposed on the third layer 554. The third layer 554 may be disposed on a substrate 556. Any number of insulation layers (e.g., insulation layer 560) may be disposed on the first layer 550 and/or between two or more of the layers 550, 552, 554 and the substrate 556. One or more insulation layers 553 may be disposed between the second layer 552 and the substrate 556 to separate the cross-overs 534, 536.

FIG. 17 shows a power amplifier circuit 600. The power amplifier circuit 600 includes inductors and transformers. Any of the inductors and transformers of the power amplifier circuit 600 may be replaced with any of the other inductors and transformers disclosed herein. The power amplifier circuit 600 includes differential power amplifier 602, 604. The power amplifier circuit 600 may receive an alternating current (AC) signal, such as a radio frequency (RF) signal, and boost power of the AC signal. The power amplifier circuit 600 may be included in a variety devices, such as mobile devices, mobile telephones, computers (such as laptop computers, tablet computers, etc.), and personal data assistants. The power amplifier circuit 600 may be used for wireless communication. An output of the power amplifier circuit 600 may be transmitted via an antenna 601.

The power amplifiers 602, 604 have similar circuits and similar circuit layouts. Each of the power amplifiers 602, 604 includes respective ones of push-pull transistors 606, 607, 608, 609 and transistors 610, 612. The transistors 610, 612 are connected respectively between transistors 606, 608 and primary windings of transformers 614, 616. The power amplifiers 602, 604 further include transistors 620, 622 connected respectively between the transistors 607, 609 and secondary windings of transformers 624, 626. Transistors 610, 612, 620, 622 may be push-pull transistors.

The transistors 606, 608, 610, 612 may be in respective cascode configurations with respective common sources and common grounds. More specifically, sources of the transistors 610, 612 may be connected to drains of the transistors 606, 608. Drains of the transistor 610, 612 may be connected to first ends of the primary windings of the transformers 614, 616, where second ends of the primary windings of the transformers 614, 616 are connected to a voltage source terminal 630 having a voltage Vdd. Gates of the transistor 610, 612 may be grounded or connected to a reference potential or the voltage source terminal 630, as shown.

Transistors 607, 609, 620, 622 may similarly be in respective cascode configurations with respective common sources and common grounds. More specifically, sources of the transistor 620, 622 may be connected to respective drains of the transistors 607, 609. Drains of the transistors 620, 622 may be connected to respective first ends of primary windings of the transformers 624, 626, where second ends of the primary windings of the transformers 624, 626 are connected to the terminal 617. Gates of the transistors 620, 622 may be grounded or connected to the terminal 617. The gates of the transistors 606, 607, 608, 609 may be inputs of the power amplifier circuit 600 and receive input signals.

The power amplifiers 602, 604 may also include capacitors 640, 642, 644, 646 across the primary windings of the transformers 614, 616, 624, 626. The capacitors 640, 642, 644, 646 may be used to tune resonant frequencies of the primary windings of the transformers 614, 616, 624, 626.

First output nodes 650, 651 are connected between the transistors 610, 612 and the primary windings of the transformers 614, 616. Sources of the transistors 606, 608 may be connected respectively to first ends of inductors 652, 654. Second ends of the inductors 652, 654 are connected to the terminal 617. Second output nodes 660, 661 are respectively connected between the transistors 620, 622 and the primary windings of the transformers 624, 626. Sources of the transistors 607, 609 are connected to first ends of inductors 664, 668, where second ends of the inductor 664, 668 are connected to the voltage reference terminal 630.

A coupler 670, via secondary windings of the transformers 614, 616, 624, 626, is configured to inductively couple output AC signals across the primary windings of the transformers inductors 614, 616, 624, 626 to the antenna 601. The secondary windings of the transformers 614, 616, 624, 626 are connected to each other.

Although the terms first, second, third, etc. may be used herein to describe various coils, inductors, windings, terminals, transformers, elements, and/or components, these items should not be limited by these terms. These terms may be only used to distinguish one item from another item. Terms such as "first," "second," and other numerical terms when used herein do not imply a sequence or order unless clearly indicated by the context. Thus, a first item discussed below could be termed a second item without departing from the teachings of the example implementations.

Various terms are used herein to describe the physical relationship between elements. When a first element is referred to as being "on", "engaged to", "connected to", or "coupled to" a second element, the first element may be directly on, engaged, connected, disposed, applied, or coupled to the second element, or intervening elements may be present. In contrast, when an element is referred to as being "directly on", "directly engaged to", "directly connected to", or "directly coupled to" another element, there may be no intervening elements present. Other words used to describe the relationship between elements should be interpreted in a like fashion (e.g., "between" versus "directly between", "adjacent" versus "directly adjacent", etc.).

The wireless communications and wireless communication circuits described in the present disclosure can be conducted in full or partial compliance with IEEE standard 802.11-2012, IEEE standard 802.16-2009, IEEE standard 802.20-2008, and/or Bluetooth Core Specification v4.0. In various implementations, Bluetooth Core Specification v4.0 may be modified by one or more of Bluetooth Core Specification Addendums 2, 3, or 4. In various implementations, IEEE 802.11-2012 may be supplemented by draft IEEE standard 802.11ac, draft IEEE standard 802.11ad, and/or draft IEEE standard 802.11ah.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A transformer comprising: a first plurality of loops comprising a first set of input terminals, wherein the first plurality of loops include at least three loops that are conductively coupled to each other in series by first crossovers; and a second plurality of loops comprising a first set of output terminals, wherein the second plurality of loops include at least three loops that are conductively coupled to each other in series by second crossovers, wherein each of the second plurality of loops is inductively coupled to and nested within a respective one of the first plurality of loops and is not nested in the other ones of the first plurality of loops, and third crossovers, wherein the first crossovers include a pair of conductors, and wherein the pair of conductors cross each other to connect to two of the first plurality of loops, the pair of conductors connect to a first loop and a second loop; the third crossovers comprise a second pair of conductors; and the second pair of conductors cross each other and connect to the second loop and a third loop.

2. The transformer of claim 1, wherein:

the first plurality of loops are non-concentric; and each of the second plurality of loops is concentric with a respective one of the first plurality of loops.

3. The transformer of claim 1, wherein the first plurality of loops and the second plurality of loops provide a double figure eight structure.

4. The transformer of claim 1, wherein:

the first plurality of loops comprise four loops; and the second plurality of loops comprise four loops.

5. The transformer of claim 4, wherein:

the first set of input terminals is the only set of input terminals of the first plurality of loops; and the first set of output terminals is the only set of output terminals of the second plurality of loops.

6. The transformer of claim 4, wherein:

the first set of input terminals is the only set of input terminals of the transformer; and the first set of output terminals is the only set of output terminals of the transformer.

7. The transformer of claim 1, wherein:

the first set of input terminals is connected to a first loop of the first plurality of loops; and the first set of output terminals is connected to a second loop of the second plurality of loops.

8. The transformer of claim 7, wherein the second loop is nested within the first loop.

9. The transformer of claim 7, wherein:

the first loop and the second loop are non-concentric; and the first set of input terminals are on a different side of the transformer than the first set of output terminals.

10. The transformer of claim 7, wherein:

the first loop and the second loop are non-concentric; and the first set of input terminals are on a same side of the transformer as the first set of output terminals.

11. A circuit comprising:

a first transformer, wherein the transformer of claim 1 is the first transformer; and a second transformer comprising a third plurality of loops, a second set of input terminals, and a second set of output terminals, wherein the first transformer is nested within the third plurality of loops.

12. The circuit of claim 11, wherein the second transformer has a non-figure eight structure.

13. The circuit of claim 11, wherein:

the second transformer comprises a fourth plurality of loops;

the third plurality of loops and the fourth plurality of loops provide a figure eight structure;

each of the fourth plurality of loops is nested within a respective one of the third plurality of loops; and the first transformer is nested within one of the third plurality of loops.

14. A transformer circuit comprising: a first transformer comprising a first winding having a first loop, and a second winding having a second loop, wherein the second loop is nested within the first loop; and a second transformer nested within the first transformer, wherein the second transformer comprises a third winding having a figure eight structure, and a fourth winding having a figure eight structure, wherein loops of the fourth winding are nested within respective loops of the third winding, and wherein three loops of the third winding are not concentric with each other or three of the loops of the fourth winding are not concentric with each other and the loops of the third winding and the loops of the fourth winding are nested completely within the first transformer.

15. The transformer circuit of claim 14, wherein:

the first winding of the first transformer has a figure eight structure; and the second winding of the first transformer has a figure eight structure, wherein loops of the second winding are nested within respective loops of the first winding.

16. The transformer circuit of claim 14, further comprising a third transformer, wherein:

the second transformer is nested in the first loop of the first transformer; and the third transformer is nested in the second loop of the first transformer.

17. The transformer of claim 14, wherein:

the third winding has a double figure eight structure; and the fourth winding has a double figure eight structure.

18. The transformer of claim 14, wherein the second transformer has a double figure eight structure.

19. The transformer of claim 1, wherein: the second crossovers comprise a third pair of conductors and a fourth pair of conductors; the third pair of conductors cross each other and connect to a fourth loop and a fifth loop; and the fourth pair of conductors cross each other and connect to the fifth loop and a sixth loop.

20. The transformer circuit of claim 14, wherein:

the third winding comprises three or more loops; and the fourth winding comprises three or more loops.

21. The transformer circuit of claim 14, wherein the first transformer is not nested within the second transformer.

22. The transformer circuit of claim 14, wherein:

the three loops of the third winding are not concentric with each other, and the three loops of the fourth winding are not concentric with each other.

* * * * *